United States Patent [19]

Kumasako et al.

[11] Patent Number: 4,566,471

[45] Date of Patent: Jan. 28, 1986

[54] CUTTING APPARATUS

[75] Inventors: Takeo Kumasako, Tokyo; Kiyomi Sato, Hiratsuka; Akira Kawakatsu, Hiratsuka; Akinori Sato, Tokyo; Isamu Mamiya, Tokyo, all of Japan

[73] Assignees: The Japan Tobacco & Salt Public Co.; Tokyo Shisetsu Kogyo Kabushiki Kaisha, both of Tokyo, Japan

[21] Appl. No.: 531,369

[22] Filed: Sep. 12, 1983

[30] Foreign Application Priority Data

Dec. 24, 1982 [JP] Japan ..... 57-225968

[51] Int. Cl.[4] ..... A24B 3/07; B26D 7/06; B26D 1/24; B23D 19/04

[52] U.S. Cl. ..... 131/317; 131/290; 83/426; 83/430; 83/435; 83/500

[58] Field of Search ..... 131/317, 290, 322, 313; 83/426, 430, 435, 500–503

[56] References Cited

FOREIGN PATENT DOCUMENTS 0279381 10/1914 Fed. Rep. of Germany ..... 131/317

*Primary Examiner*—V. Millin

*Attorney, Agent, or Firm*—Armstong, Nikaido, Marmelstein & Kubovcik

[57] ABSTRACT

A cutting apparatus for cutting tobacco leaves into small pieces. The cutting apparatus has a feed belt conveyor including a plurality of parallel narrow endless belts. At the tail section of the feed belt conveyor is provided a pulley on which a plurality of lower rotary cutting blades are coaxially mounted. The diameter of the blades is larger than that of the pulley and each lower cutting blade projects from between adjacent narrow endless belts. There are further provided a plurality of upper rotary cutting blades above the lower rotary cutting blades and each upper rotary cutting blade overlaps each corresponding lower rotary cutting blade. The endless belts are led to proceed from the pulley but not to proceed beyond the outfeeding edges of the lower rotary cutting blades and then return to the head section after they pass the overlap section.

10 Claims, 22 Drawing Figures

CUTTING APPARATUS

BACKGROUND OF THE INVENTION

This invention relates to an apparatus for cutting tobacco leaves and, more particularly, to a cutting apparatus, which can cut a great quantity of continuously supplied tobacco leaves without stagnation.

As a method of efficiently taking out laminas of tobacco leaves by removing stems thereof, there is one, in which tobacco leaves are cut in the manner as shown in FIG. 1 and the cut pieces of tobacco leaves are sorted into pieces free from any stem portion a but consisting of the sole lamina and pieces c with a stem portion a, the stem portions a in the pieces being subsequently pulled apart.

To cut tobacco leaves by the method as shown in FIG. 1, two cutting apparatuses as shown in FIG. 2, for instance, are disposed at right angles to each other so that tobacco leaves are cut in one direction by one of the apparatuses and then cut in the perpendicular direction by the other apparatus.

The cutting apparatus shown in FIG. 2 has a supply belt conveyor e consisting of a plurality of narrow parallel endless belts. A row of lower rotary cutting blades f is disposed under a central portion of the upper run of the supply belt conveyor e such that the individual rotary cutting blades f partly project from between adjacent narrow endless belts. A row of upper rotary cutting blades g is disposed above the belt conveyor upper run such that the individual rotary cutting blades g overlap the corresponding upper rotary cutting blades f. With this apparatus, it often occurs that tobacco leaves having been cut by the blades are dragged into the space under the upper belt conveyor run from the point A at which the edge of the lower rotary cutting blades f crosses the upper belt conveyor run by the rotational force of the blades f. If this happens, it will cause jamming or otherwise disturb an orderly arranged state of tobacco leaves to disable continuous cutting thereof.

Accordingly, there has been proposed an apparatus as shown in FIG. 3 (which is disclosed in U.S. Pat. Nos. 3,128,775 and 2,984,276). In this instance, a row of lower rotary cutting blades f and a row of upper rotary cutting blades g are disposed at a position slightly spaced apart from the head or tail of a supply belt conveyor e (which consists of a wide endless belt), and coupling members or guide members i are disposed between the set of lower and upper rotary cutting blades f and g and supply belt conveyor e. In this arrangement, however, the force of supplying tobacco leaves into between the lower and upper rotary cutting blades f and g or the force of bringing out cut tobacco leaves from between the blades f and g is rather weak and insufficient. Therefore, jamming or disturbance of the arrangement of tobacco leaves is liable to occur at a position before or after the set of the lower and upper rotary cutting blades f and g, thus disabling the continuous cutting operation.

SUMMARY OF THE INVENTION

The invention has been intended in the light of the above problems, and it purposes to provide a cutting apparatus, which can cut tobacco leaves with no possibility of occurrence of jamming or disturbance of arrangement of tobacco leaves.

Another purpose of the invention is to provide a cutting apparatus, which can continuously cut tobacco leaves and can also provide accessibility for maintenance.

A further purpose of the invention is to provide a cutting apparatus, which can cut tobacco leaves continuously and in a great quantity and also by preliminarily bringing about a sandwiched state of the tobacco leaves for cutting.

A still further purpose of the invention is to provide a cutting apparatus, which can continuously cut tobacco leaves and also remove matter adhering to upper and lower rotary cutting blades when it operates.

A still further purpose of the invention is to provide a cutting apparatus, with which the cutting blades can be polished while continuously cutting tobacco leaves.

DETAILED DESCRIPTION OF THE EMBODIMENTS

Preferred embodiments of the invention will now be described with reference to the accompanying drawings.

Figure 4:
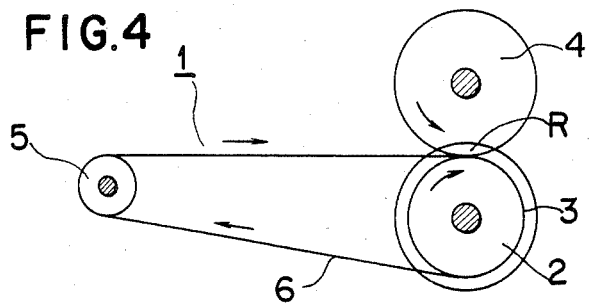
FIG. 4 is a schematic view showing an embodiment of the invention.

FIG. 4 is a schematic view showing a first embodiment of the invention. In this embodiment, a feed belt conveyor 1 having a plurality of parallel narrow endless belts 6 is passed round a head pulley 2, which has a row of lower rotary cutting blades 3 having a diameter greater than its diameter. A row of upper rotary cutting blades 4 having the same diameter as the lower rotary cutting blades 3 is disposed such that the individual upper blades 4 partly overlap the corresponding lower blades 3. The feed belt conveyor 1 is also passed round a tail pulley 5 at the other end.

Figure 5:
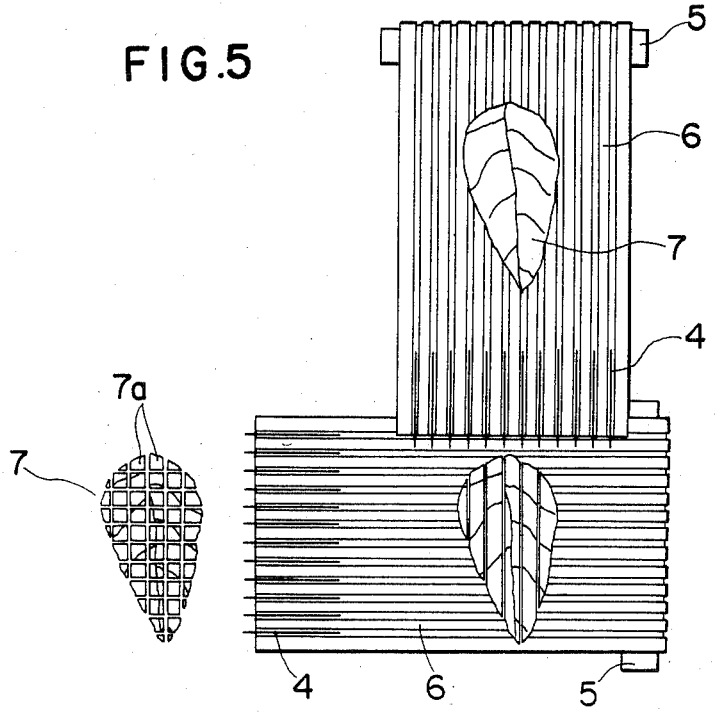
FIG. 5 is a view showing the disposition of cutting apparatus.

Two cutting apparatuses each having the construction as described are disposed at right angles to each other as shown in FIG. 5. Tobacco leaves 7 supplied to the endless belts 6 of one of the cutting apparatuses are cut in one direction by the lower and upper rotary cutting blades 3 and 4. The cut tobacco leaves 7 emerging from the blades 3 and 4 are transferred maintaining the same orientation onto the endless belts 6 of the other cutting apparatus and further cut in the perpendicular direction into square pieces 7*a*.

In this embodiment, the lower rotary cutting blades 3 having a greater diameter than the head pulley 2 are coaxially mounted on the same. Thus, after the endless belts 6 clear the overlap section R in the direction of their progress, they will not continually proceed beyond the edge of the lower rotary cutting blades 3 but return to the tail end of the feed belt conveyor. That is, where tobacco leaves pass the lower rotary cutting blades 3, there are no belts 6, so that the cut tobacco leaves 7 will never jam right after they clear the lower rotary cutting blades 3. Instead, they fall from the belts 6 right after they pass the lower rotary cutting blades 3. Thus, there is no possibility for the cut tobacco leaves to be dragged into spaces between the belts 6. Also, there is no possibility of disturbance of the arrangement of tobacco leaves.

Further, since the tobacco leaves 7 are transported on the endless belts 6, a sufficient force can be ensured for forcing the tobacco leaves 7 into between the lower and upper rotary cutting blades 3 and 4 or for pushing out the cut tobacco leaves from between the blades 3 and 4. Further, there is no possibility of occurrence of jamming of tobacco leaves 7 at a position before or after the set of upper and lower roatry cutting blades 4 and 3.

Figure 6:
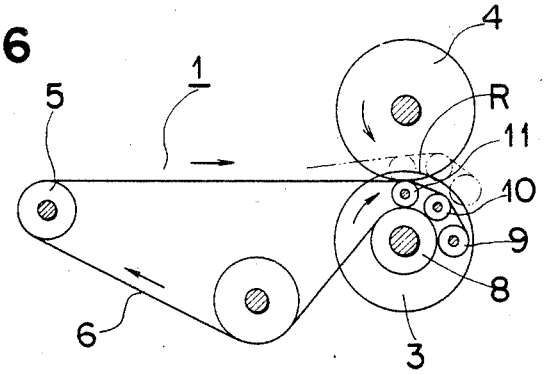
FIG. 6 is a schematic view showing a second embodiment of the invention.

FIG. 6 is a schematic view showing a second embodiment of the invention. In this embodiment, lower rotary cutting blades 3 are coaxially mounted on a first return pulley 8 instead of the head pulley in the case of the preceding first embodiment. A second return pulley 9 is disposed on the outer periphery of the first return pulley 8 at a position thereof after overlap section R between lower and upper rotary cutting blades 3 and 4. The second return pulley 9 has a diameter smaller than the difference between the radius of the lower rotary cutting blades 3 and the radius of the first return pulley 8. Guide pulleys 10 and 11 are disposed on the outer periphery of the return pulleys 8 in the neighborhood of the overlap section R.

As the belts 6 proceed through the overlap section R, they are guided by the guide pulleys 10 and 11 and then they are U-turned round the second return pulley 9. As they proceed from the second return pulley 9, they pass between the first return pulley 8 on one hand and the second return pulley 9 and guide pulleys 10 and 11 on the other hand.

Again in this embodiment, when the endless belts 6 clear the overlap section R in the direction of their progress, they will not continually proceed beyond the edge of the lower rotary cutting blades 3 but return to the head end of the belt conveyor. That is, where tobacco leaves the lower rotary cutting blades 3, there are no belts 6, so that the cut tobacco leaves 7 will never jam right after they pass the lower rotary cutting blades, but they fall from the belts 6 right after they pass the lower rotary cutting blades, thus eliminating the possibility for the cut tobacco leaves to be dragged into spaces between the belts 6 and the possibility of disturbance of the arrangement of tobacco leaves.

Further, since the tobacco leaves 7 are transported on the endless belts 6, there is no possibility of jamming at a position before or after the set of the upper and lower rotary cutting blades 4 and 3 as in the previous first embodiment.

The second embodiment will now be described in further detail.

Figure 7:
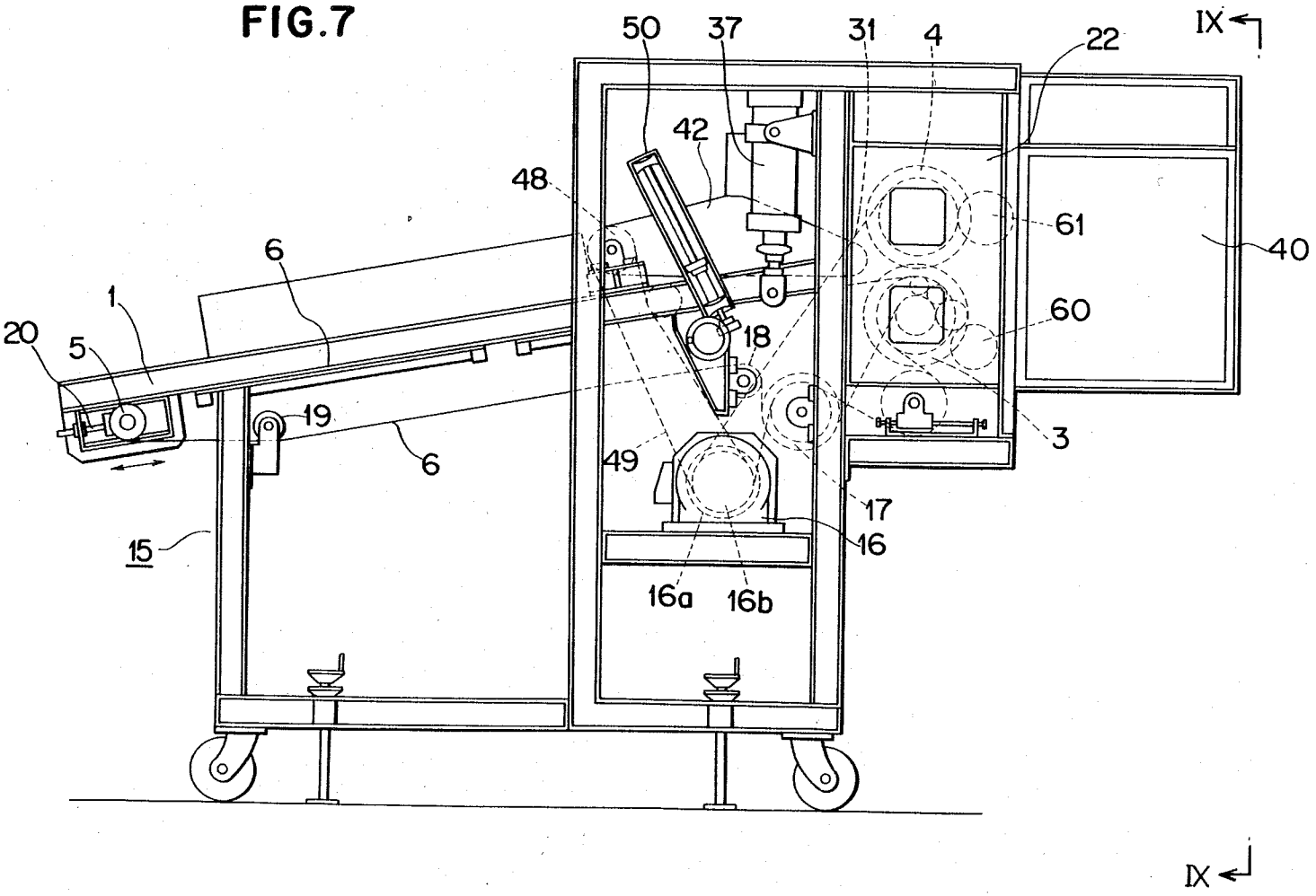
FIGS. 7 through 21 are views illustrating a second embodiment, with FIG. 7 being a side view of the entire apparatus, FIG. 8 being a plan view of the same, FIG. 9 being a view taken along line IX—IX in FIG. 7, FIG. 10 being a view showing the disposition of upper and lower rotary cutting blades 4 and 3 and return pulley 8, FIGS. 11*a* and 11*b* being views explanatory of the lap between the upper and lower rotary cutting blades, FIG. 12 being an enlarged-scale sectional view showing a holder 28 of an upper rotary cutting blade 4, FIG. 13 being a view showing the disposition of a head pulley 9 and guide pulleys 10 and 11, FIG. 14 being a view taken along line XIV—XIV in FIG. 13, FIG. 15 being a plan view of a belt conveyor 42, FIG. 16 being a side view of the same, FIGS. 17 and 18 being schematic views showing a lifting means 50 for the belt conveyor 42, FIG. 19 being a plan view showing a unit 60, FIG. 20 being a side view of the same, and FIG. 21 being a view showing polishing means.
Figure 8:
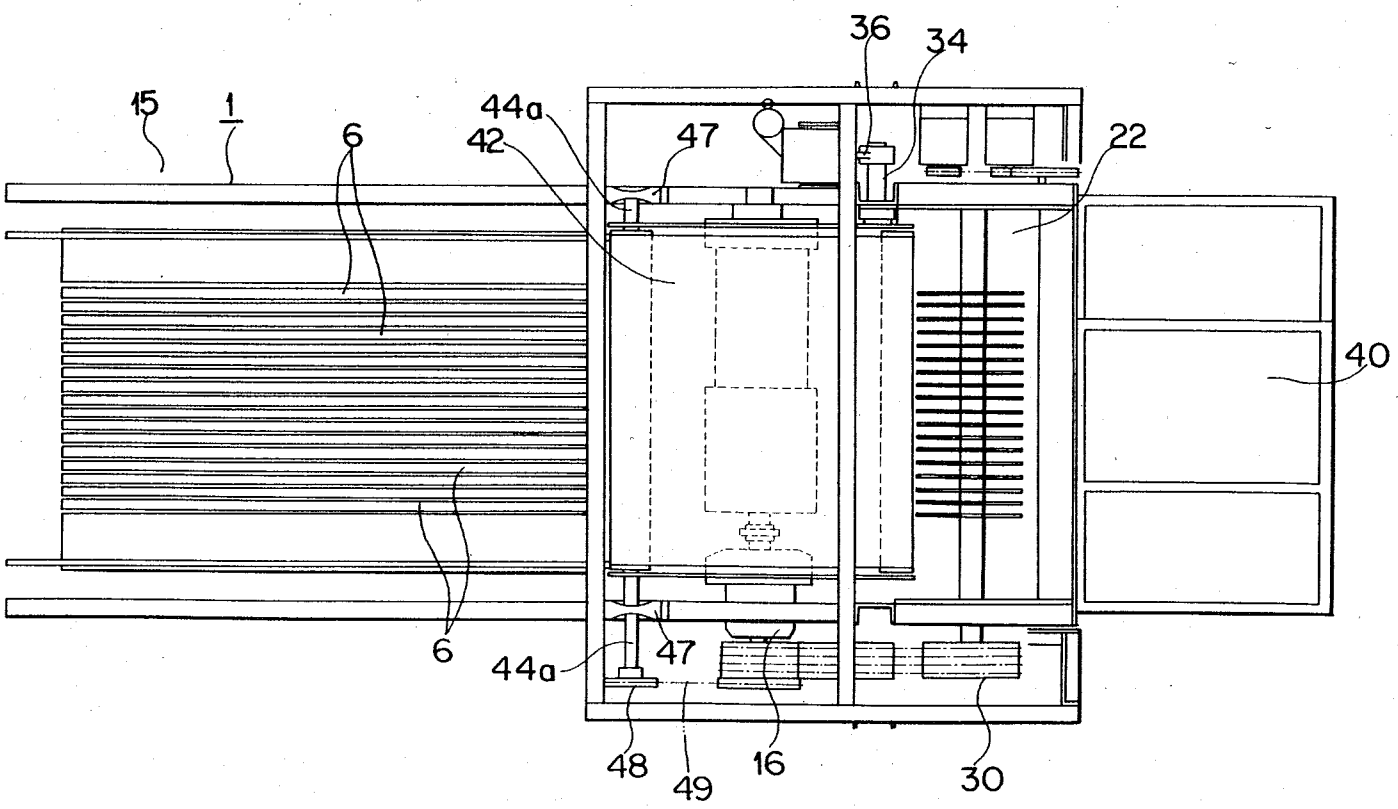

FIG. 7 is a side view of the second embodiment of the cutting apparatus, and FIG. 8 is a plan view of the same. Reference numeral 15 in these Figures designates a frame supporting the entire apparatus. A motor 16 is mounted in the frame 15, and the feed belt conveyor 1 and upper and lower rotary cutting blades 4 and 3 are driven from the motor 16.

The feed belt conveyor 1 is supported in the frame 15 in an inclined state with its head (right side in Figure) at a higher level than its head (left side in the Figure).

The belt conveyor 1 has a plurality of (17 in the Figure) parallel narrow endless belts 6 (see FIG. 8). Each endless belt 6 has a width smaller than the gap between adjacent lower rotary cutting blades 3. Guide pulleys 17 to 19 are disposed in the frame 15. The belts 6 are passed round a pulley 16*a* of the motor 16 and also on the guide pulleys 17 to 19. A mechanism 20 for displacing a pulley 5 is disposed in the frame 15. The tension in the belts 6 is adjusted by moving the tail pulley 5 with respect to the frame 15 with the mechanism 20.

Figure 10:
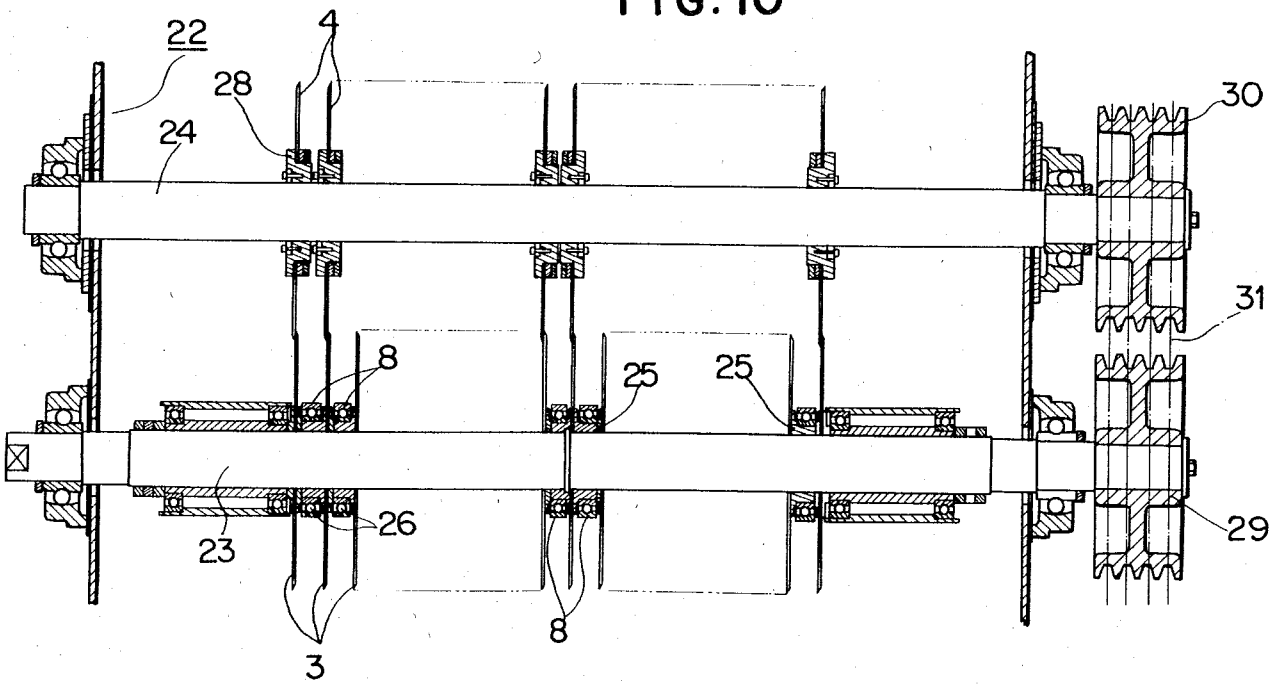

A cutting section 22 is removably mounted in the frame 15. It has the return pulley 8 and upper and lower rotary cutting blades 4 and 3. FIG. 10 shows the first return pulley 8 and upper and lower rotary cutting blades 4 and 3 in detail. In the cutting section 22, a lower shaft 23 and an upper shaft 24 are disposed parallel to each other. The lower shaft 23 has a plurality of (18 in this embodiment) lower rotary cutting blades 3 mounted via holders 25 at a predetermined interval. Bearings 26 are provided between adjacent lower rotary cutting blades 26. The outer rings of the bearings 26 constitute the first return pulley 8 noted above. The inner rings of the bearings 26 and holders 25 are mounted on the lower shaft 23 against rotation. The upper shaft 24 has upper rotary cutting blades 4 equal in number to the number of the lower rotary cutting blades 4 mounted via holders 28. The lower and upper shafts 23 and 24 have pulleys 29 and 30 mounted on one end. Power transmission belts 31 (FIG. 7) are passed round these pulleys 29 and 30 and the pulley 16*b* of the motor 16. The rotational speed of the upper and lower rotary cutting blades 4 and 3 is set to, for instance, 82.6 to 165.2 rpm. The upper and lower rotary cutting blades 4 and 3 have a diameter of 340 mm. They are rotatable in opposite directions. In the succeeding perpendicular cutting apparatatus, the rotational speed of the upper and lower rotary cutting blades is desirably set to approximately one half the value noted.

Figure 11A:
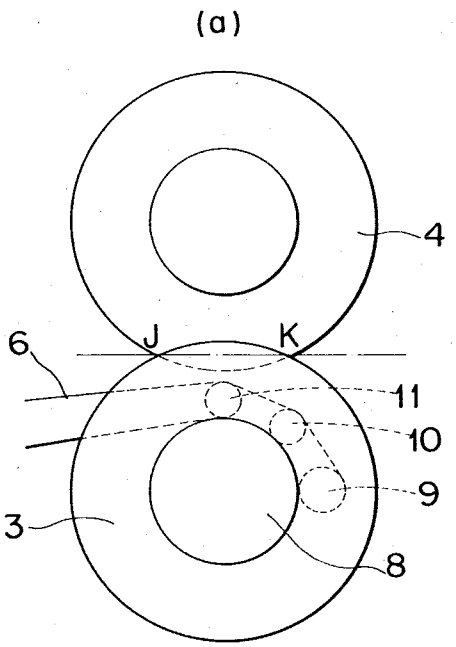
Figure 11B:
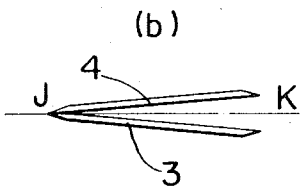

FIG. 11*a* shows the overlapping of the lower and upper rotary cutting blades 3 and 4 in detail. The overlap between the blades 3 and 4 is set to 5 to 30 mm. In the overlap section, the lower and upper rotary cutting blades 3 and 4 are slightly inclined relative to one another (see FIG. 11*b*) to prevent collection of nicotine in the overlap section. The two blades 3 and 4 thus are in contact with one another at a point J in FIG. 11*a* while they are slightly spaced apart at a point K.

Figure 12:
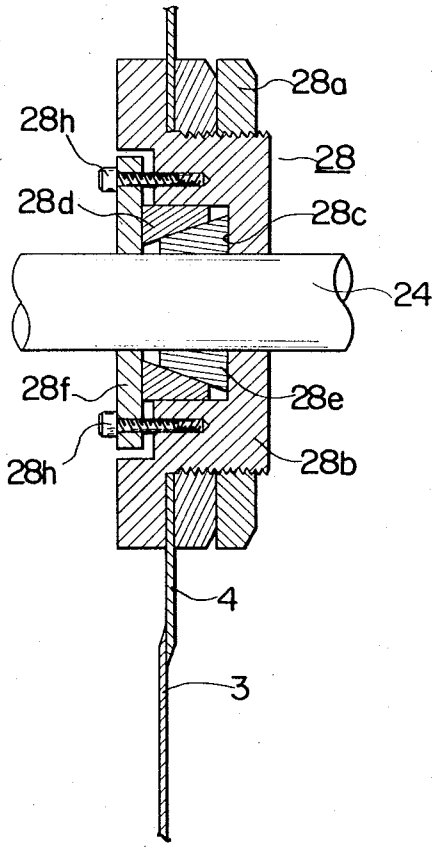

FIG. 12 shows the holder 28 in detail. In the Figure, the holder 28 consists of a holder body 28*b*, to which the corresponding upper rotary cutting blade 4 is secured by a double nut 28*a*, an outer and inner tapered ring 28*d* and 28*e* fitted in a recess 28*c* formed in the holder body 28*b*, and a retainer ring 28*f* to urge the outer tapered ring 28*d* into the recess 28*c*. Although not shown, the inner tapered ring 28*e* has a gap. When bolts 28*h* are clamped to urge the outer tapered ring 28*d* with the retainer ring 28*f*, the inner tapered ring 28*e* is urged tight against the upper shaft 24. The holder 28 is thus secured to the upper shaft 24. This structure of the holder 28 permits adjustment for making up for a deviation from the desired overlap of the upper rotary cutting blade 4 with the corresponding lower rotary cutting blade 3 when the upper rotary cutting blade 4 is set on the upper shaft 24 at a desired position thereof due to a machining error or the like.

Figure 13:
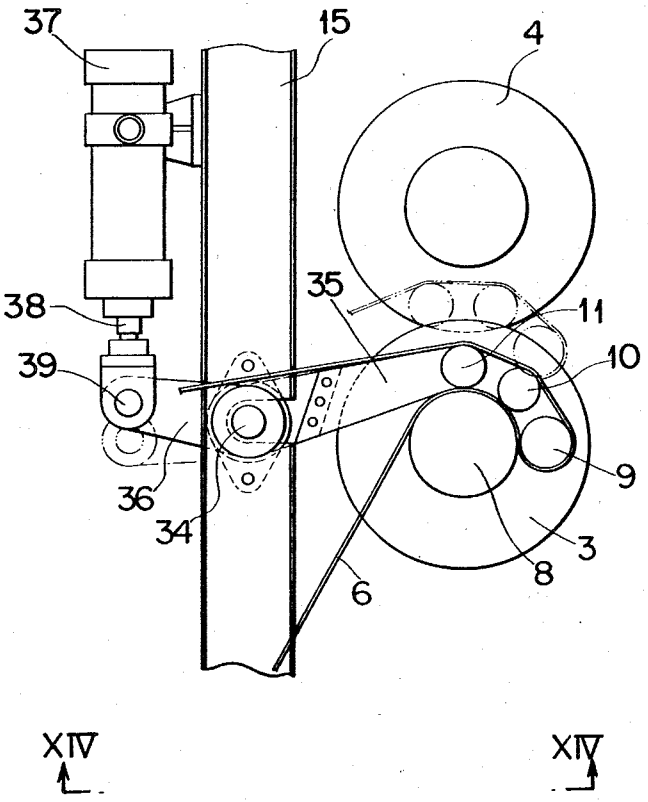
Figure 14:
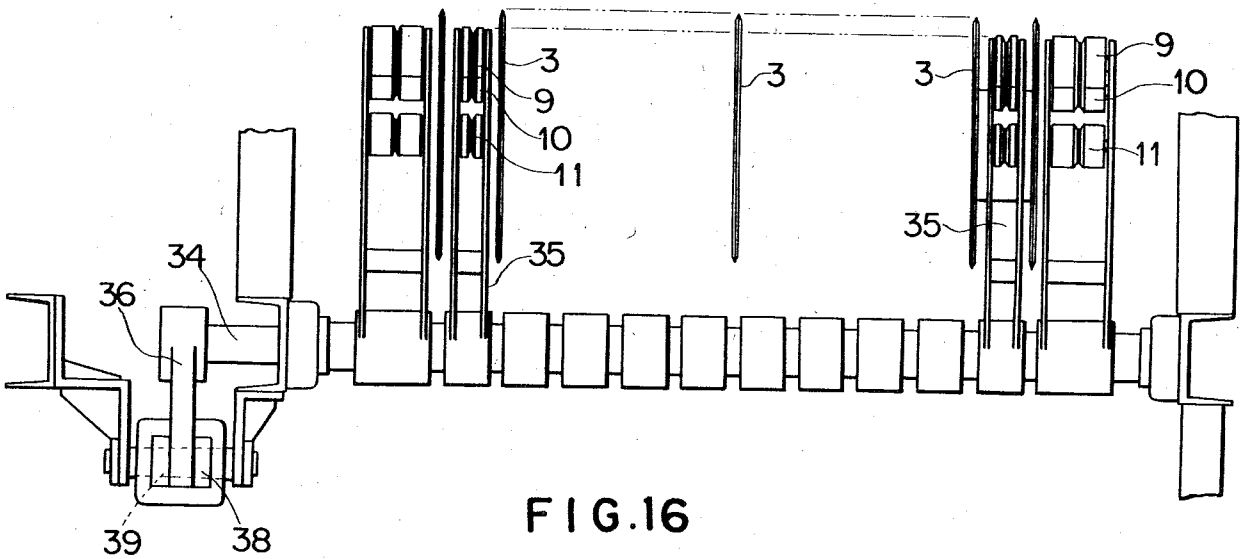

FIGS. 13 and 14 show the positional relation amoung the head pulley 9 and guide pulleys 10 and 11 in detail. In the Figures, a horizontal shaft 34 is rotatably mounted in the frame 15. A plurality of pulley mounting arms 35 project in a row from the outer periphery of the first return pulley 8. The second return pulley 9 and guide pulleys 10 and 11 are rotatably mounted in end portions of the pulley mounting arms 35. The shaft 34 also has a coupling arm 36 projecting from an end of it in the opposite direction to the pulley mounting arms 35. An end of a rod 38 of an air cylinder 37 mounted on the frame 15 is coupled by a pin 39 to the end of the coupling arm 36.

When the rod 38 of the air cylinder 37 is advanced, the shaft 34 is rotated to separate the second return pulley 9 and guide pulleys 10 and 11 from the first return pulley 8 as shown by phantom lines in FIG. 13. In this state, the cutting section 22 with the upper and lower rotary cutting blades 10 and 11 and first return pulley 8 can be removed from the frame 15. Thus, there is no need of such a cumbersome operation of removing the belts 6 when servicing the upper and lower rotary cutting blades 4 and 3 for maintenance.

The frame 15 has a spare section 40 (FIG. 7) to permit ready replacement of the cutting section 22. In the spare section 40, a spare cutting section 22 can be mounted. When the cutting section 22 is removed from the frame 15 for maintenance, the spare cutting section 22 can be immediately set in the frame 15. Thus, the period of interruption of operation of the apparatus for maintenance can be reduced to improve the duty service efficiency. Although not shown in detail, the spare section 40 includes means for transporting the cutting section 22 and lift means for bringing the cutting section 22 to the ground. The transporting means and lifting means may be those well known in the art.

In the second embodiment, in addition to the fact that the replacement of the cutting section 22 can be readily done, there are provided means for bringing tobacco leaves to be cut into a sandwiched form so that they are not bulky, means for removing matter attached to the upper and lower rotary cutting blades 4 and 3 and means for polishing the upper and lower rotary cutting blades 4 and 3.

First means for bringing tobacco leaves into a sandwiched state will be described.

Figure 15:
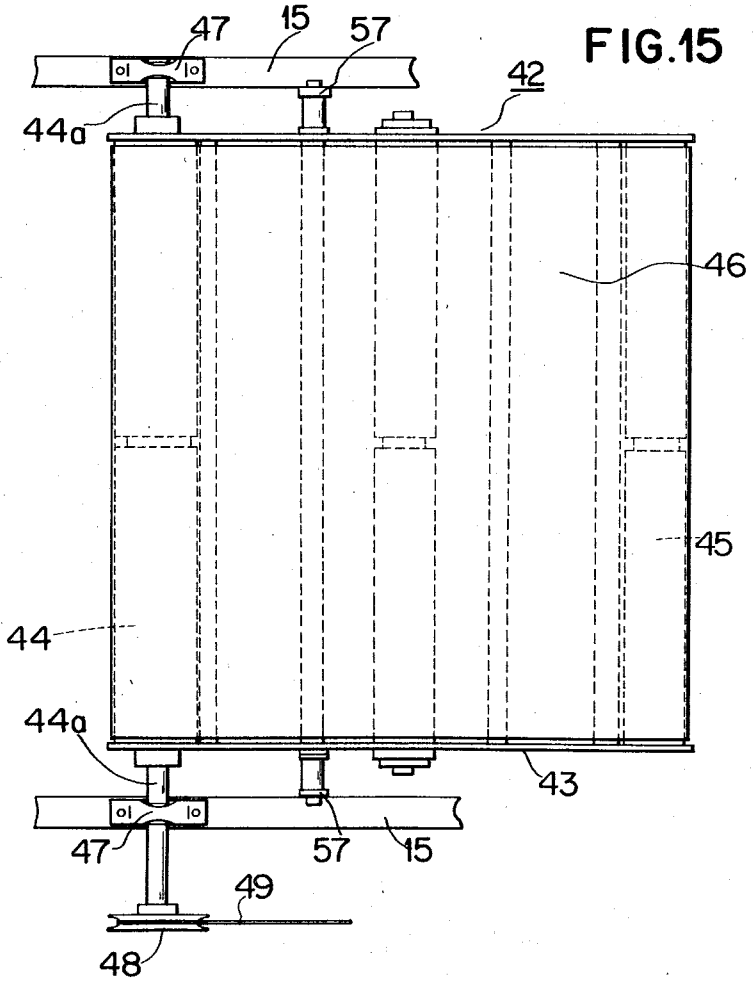
Figure 16:
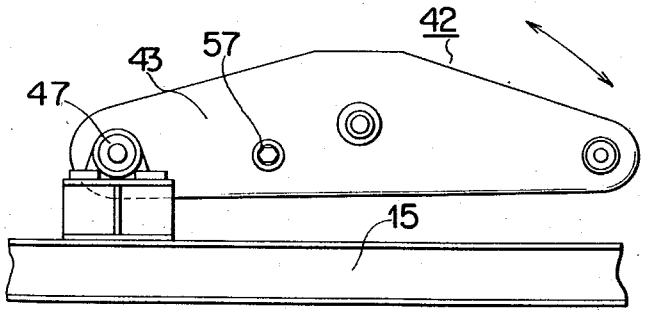

As shown in FIG. 7, a belt conveyor 42 is provided such that one end is located in the neighborhood of the feed belt conveyor 1. It is rockable about a bearing section 47 (FIG. 15) so that it can urge tobacco leaves against the belts 6 by its own weight and hold the tobacco leaves such that they are not bulky. As shown in FIGS. 15 and 16, it has an endless belt 46 passed round pulleys 44 and 45 provided in a conveyor frame 43. The pulley 44 has shafts 44*a* projecting from its opposite ends. These shafts 44*a* are rotatably supported in bearings 47 provided in the frame 15. One of these shafts 44*a* has a pulley 48 secured to its end. A power transmission belt 49 is passed round the pulley 48 and the pulley 16*b* of the motor 16. The belt 46 is driven by the motor 16 in the direction of transporting tobacco leaves to the head of the belt conveyor 1.

Figure 18:
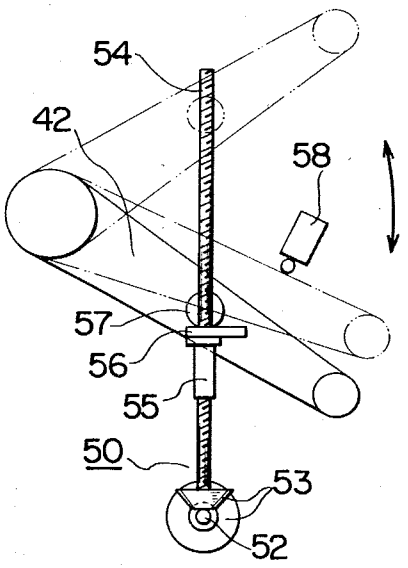
Figure 17:
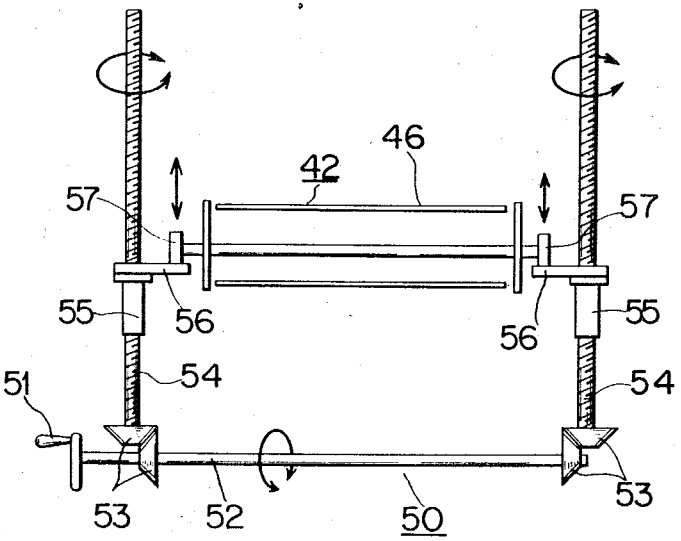

FIGS. 17 and 18 show in detail lifting means for raising the belt conveyor 42 from the belts 6 for maintenance. The lifting means 50 includes a main shaft 52 rotatable by a handle 51, a pair of threaded poles 54, to which the rotation of the main shaft 51 is transmitted through bevel gears 53, and nuts 55 screwed on the respective threaded poles 54. The nuts 55 respectively have integral support members 56. Rollers 57 projecting from the opposite sides of the frame 43 of the belt conveyor 42 are suppported by the support members 56.

When the main shaft 52 is rotated in one direction by the manual handle 51 to make maintenance, the rotation is transmitted via the bevel gears 53 to the threaded poles 54 to cause an ascent of the nuts along the threaded poles 54, whereby the belt conveyor 42 is rocked upwards about the bearing section 47. After the maintenace work is over, the main shaft 52 is rotated in the opposite direction by the handle 51, whereby the nuts 55 are lowered to turn the belt conveyor onto the belts 6. Numeral 58 in FIG. 18 designates a limit switch.

Now, the means for removing matter attached to the upper and lower rotary cutting blades 4 and 3 during the operation of the apparatus and means for polishing the blades 4 and 3 will be described.

Figure 19:
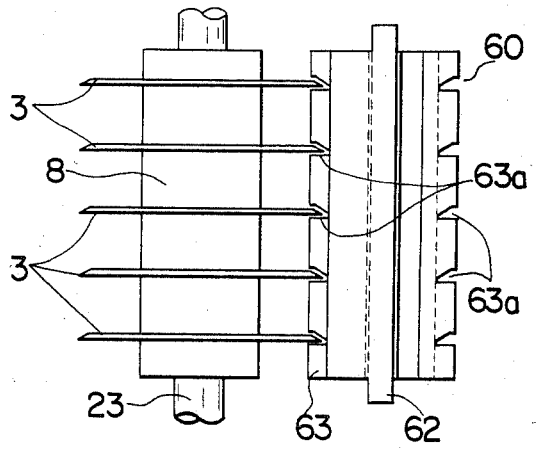
Figure 20:
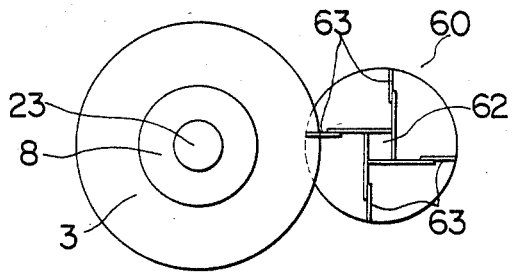

The means for removing attached matter (cut pieces of tobacco leaves), as shown in FIG. 7, includes units 60 and 61. These units are disposed in the cutting section 22 such that they face the upper and lower rotary cutting blades 4 and 3, respectively. FIGS. 19 and 20 show the units 60 associating with the lower rotary cutting blades 3 in detail. The unit 61 associating with the upper rotary cutting blades 4 have the same construction as the unit 60. Referring to the Figures, a unit 62 extends parallel to the lower shaft 61. The unit 62 has edge portions provided with felt strips 63. The felt strips 63 each have notches 63*a*, which can receive the edges of the lower rotary cutting blades 3. The unit 62 has a pulley (not shown), to which the rotation of the motor 16 is transmitted. The unit 62 is rotated in the direction opposite to the direction of rotation of the lower rotary cutting blades 3, and its rotational speed is set to be higher than that of the blades 3, for instance to approximately 1,455 rpm. In the unit 61 provided for the upper rotary cutting blades 4, the rotational speed of the unit is set to approximately 727.7 rpm.

Figure 21:
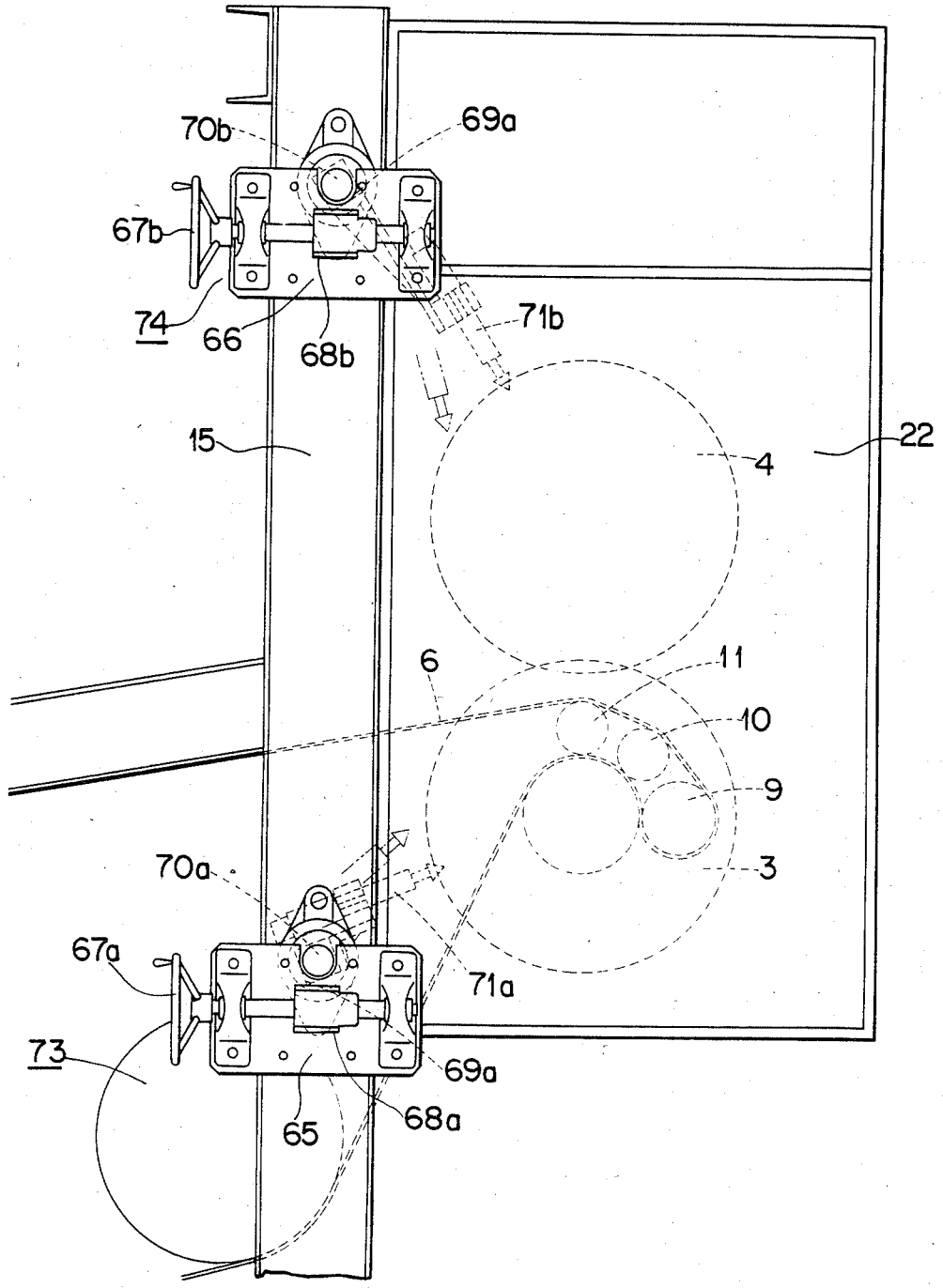

The means for polishing the upper and lower rotary cutting blades 4 and 3 are shown in detail in FIG. 21. Referring to the Figure, polishing units 73 and 74 have respective worm mounting brackets 65 and 66 mounted on frame 15 in vertically spaced-apart positions thereof. Worm gears 68*a* and 68*b* having integral handles 67*a* and 67*b* provided at one end are rotatably mounted in the worm mounting brackets 65 and 66. Worm wheels 69*a* and 69*b* in mesh with the worm gears 68*a* and 68*b* are rotatably mounted in the brackets 65 and 66. Although not shown in detail, horizontal shafts 70*a* and 70*b* rotatably mounted in the frame 15 are secured to the respective worm wheels 69*a* and 69*b*. Air grinders 71*a* corresponding to the lower rotary cutting blades 3 are secured to a shaft 70*a* which is in turn secured to the worm wheel 69*a* of the worm mounting bracket 65 mounted on the frame 15 at a lower position thereof. Air grinders 71*b* corresponding to the upper rotary cutting blades 4 are secured to the shaft 70*b* which is in turn secured to the worm wheel 69*b* mounted in the worm mounting bracket 66 secured to the frame 15 at an upper portion thereof.

The air grinders 71*a* can be brought into contact with the lower rotary cutting blades 3 by turning the handle 67*a* in one direction. When polishing the lower rotary cutting blades 3, the blades and air grinders 71*a* are both rotated. The air grinders 71*b* can be brought into contact with the upper rotary cutting blades 4 in the same manner and the upper rotary cutting blades 4 and air grinders 71*b* are both rotated for polishing.

Figure 9:
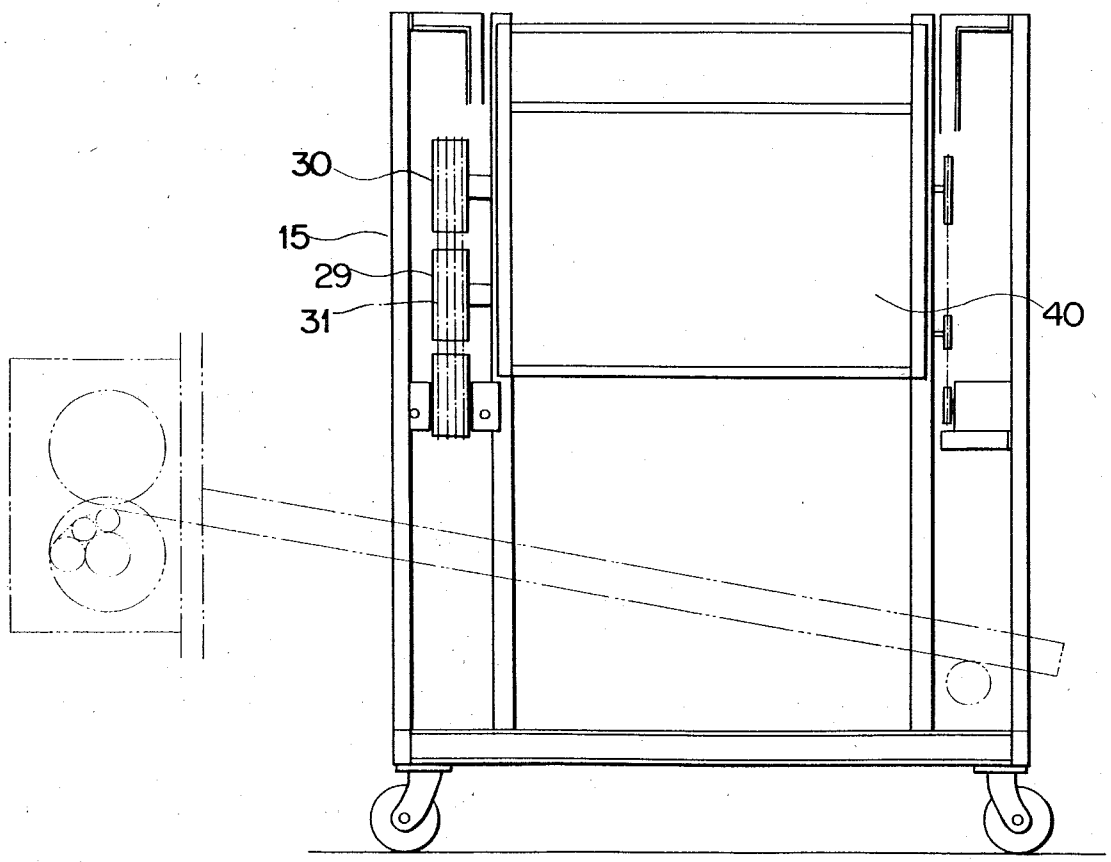

Two cutting apparatuses, each of which has been described in detail as the second embodiment, are disposed in a perpendicular relation to each other in the same way as shown in FIG. 5 to cut tobacco leaves. One of the cutting apparatuses is disposed at a lower level than the other (see FIG. 9). The rotational speed of the upper and lower rotary cutting blades in one cutting apparatus is set to approximately one half the rotational speed in the other apparatus.

An experiment of cutting tobacco leaves conducted using the second embodiment of cutting apparatus will now be described.

In the first stage cutting apparatus, eighteen blades were used as the upper and lower rotary cutting blades 4 and 3, the cutting width was set to 40 mm, and the speed of the feed belt conveyor 1 was set to 90 m/min. In the second stage cutting apparatus, ten blades were provided for both the upper and lower rotary cutting blades, the cutting width was set to 80 mm, and the speed of the feed belt conveyor was set to 40 m/min.

Tobacco leaves that were used contained 19+3% of moisture.

Figure 1:
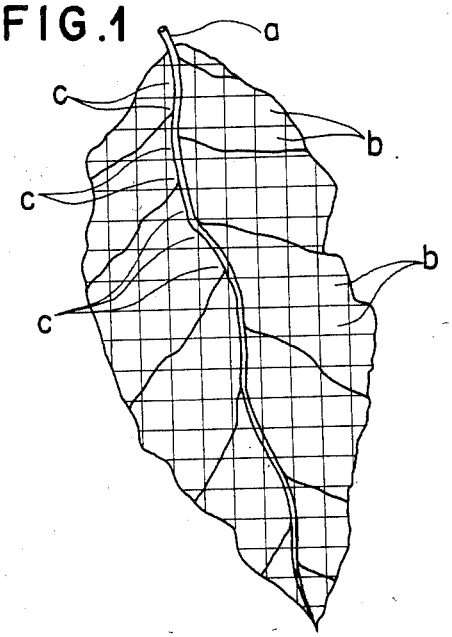
FIG. 1 is a view showing the manner of cutting a tobacco leaf.
Figure 2:
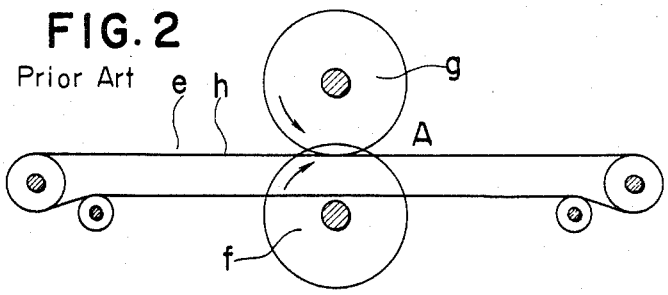
FIG. 2 Prior Art
FIGS. 2 and 3 are schematic views showing prior art apparatuses.
Figure 3:
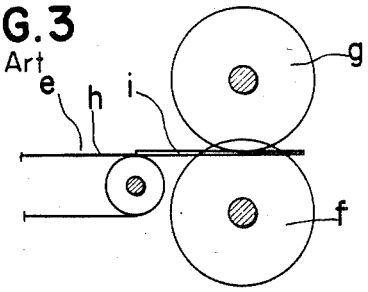
FIG.3 Prior Art

Table 1 below shows the result of cutting of tobacco leaves carried out under the conditions noted above. For the sake of comparison, results of cutting tobacco leaves obtained using the cutting apparatus shown in FIG. 2 or 3 are also listed.

TABLE 1

| Cutting apparatus | Rate of processing | Rate of generation of dust of 3 mm or less | Operating status (in 8-hour continuous operation) |
|---|---|---|---|
| According to the invention | 8,000 kg/h | 0.7% | Satisfactory and no trouble |
| Prior art (apparatus shown in FIGS. 2 and 3) | 4,000 kg/h | 1.4% (apparatus shown in FIG. 2) | Jamming occurred three times (apparatus shown in FIG. 2) |
| | | 2.5% (apparatus shown in FIG. 3) | Jamming occurred five times (apparatus shown in FIG. 3) |

Obviously from the Table, according to the invention it is possible to obtain continuous operation for 8 hours without any trouble.

As has been described in the foregoing, the cutting apparatus according to the invention comprises a feed belt conveyor consisting of a plurality of parallel narrow endless belts, a plurality of juxtaposed lower rotary cutting blades coaxially mounted on and having a greater diameter than a pulley at a head portion of the feed belt conveyor, and upper rotary cutting blades disposed above the respective lower rotary cutting blades in a overlapped relation thereto, with the endless belts being led to proceed from the pulley without passing the edge of the lower rotary cutting blades but returning to the tail end of the feed belt conveyor after they pass the overlap section. Thus, the cut matter (i.e., cut tobacco leaves) will never jam by being dragged by the lower rotary cutting blades, but they will fall from the belts immediately, and the arrangement of tobacco leaves will never be disturbed. The matter supplied to the feed belt conveyor thus can be cut continuously without any trouble, and it is possible to increase the rate of processing and reduce dust of processing.

Further, with the pulley noted above used as a return pulley, a head pulley of such a diameter that it will not project from the edge of the lower rotary cutting blades and provided such that it can be brought into contact with and separated from the outer periphery of the return pulley, and with the upper and lower rotary cutting blades made removable as a set from the frame supporting the feed belt conveyor, there is no need of removing the belts whenever the upper and lower rotary cutting blades are to be serviced for maintenance, and maintenance thus can be done readily and quickly.

Further, with a belt conveyor rockably provided over the feed belt conveyor, the tobacco leaves to be cut can be held such that they are not bulky so that it is possible to obtain cutting at a high rate.

Further with the provision of removal units the cut matter adhered to the upper and lower rotary cutting blades can be removed.

Further with the provision of polishing units it is possible to ensure the sharpness of the upper and lower rotary cutting blades at all times.

What is claimed is:

1. A cutting apparatus comprising:

a feed belt conveyer including a plurality of parallel narrow endless belts, said feed belt conveyor having a head section and a tail section;

a pulley provided at said head section;

a plurality of lower rotary cutting blades coaxially mounted on said pulley and having a diameter greater than that of said pulley, each said lower rotary cutting blade projecting from between adjacent narrow endless belts of said feed belt conveyor; and a plurality of upper rotary cutting blades provided above said lower rotary cutting blades, said lower and upper rotary cutting blades defining therebetween an overlap section such that each upper rotary cutting blade partly overlaps a lower rotary cutting blade corresponding thereto, said narrow endless belts of said feed belt conveyor being led to proceed from said pulley at said head section while not passing beyond outfeeding edges of said lower rotary cutting blades and back to said tail section after said narrow endless pass said overlap section.

2. The cutting apparatus according to claim 1, which further comprises a retainer belt conveyor rockably provided above said feed belt conveyor such as to co-operate with said feed belt conveyor to feed the matter to be cut in a sandwiched state to said head section.

3. The cutting apparatus according to claim 1 or 2, which further comprises lower and upper removal units corresponding to said lower and upper rotary cutting blades respectively, said removal units over-lapping said lower and upper rotary cutting blades and being rotatable in the direction of rotation of said cutting blades.

4. The cutting apparatus according to claim 1 or 2, which further comprises lower and upper grinders corresponding to said lower and upper rotary cutting blades respectively, said grinders being capable of being brought into contact with and separated from said respective cutting blades.

5. A cutting apparatus comprising:

a frame;

a feed belt conveyor installed within said frame and including a plurality of parallel narrow endless belts, said feed belt conveyor having a head section and tail section;

a first pulley provided at said head section;

a plurality of lower rotary cutting blades coaxially mounted on said first pulley and having a diameter greater than that of said first pulley, each said lower rotary cutting blade projecting from between adjacent narrow endless belts of said feed belt conveyor;

a plurality of upper rotary cutting blades provided above said rotary cutting blades, said lower and upper rotary cutting blades defining therebetween an overlap section such that each upper rotary cutting blade partly overlaps a lower rotary cutting blade corresponding thereto; and a second pulley adapted to be brought into and out of contact with an outer pheriphery of said first pulley beyond said overlap section, said second pulley having a size such that said second pulley does not project from the edge of said lower rotary cutting blades when in contact with said first pulley, said narrow endless belts of said feed belt conveyor being thereby led to proceed from said first pulley while not passing beyond outfeeding edges of said lower and upper rotary cutting blades, said lower and upper rotary cutting blades both being adapted to be removably mounted in said frame.

6. The cutting apparatus according to claim 5, which further comprises a retainer belt conveyor rockably provided above said feed belt conveyor such as to co-operate with said feed belt conveyor to feed the matter to be cut in a sandwiched state to said head section.

7. The cutting apparatus according to claim 5 or 6, which further comprises lower and upper removal units corresponding to said lower and upper rotary cutting blades respectively, said removal units over-lapping said lower and upper rotary cutting blades and being rotatable in the direction of rotation of said cutting blades.

8. The cutting apparatus according to claim 5 or 6 which further comprises lower and upper grinders corresponding to said lower and upper rotary cutting blades respectively, said grinders being capable of being brought into contact with and separated from said respective cutting blades.

9. The cutting apparatus according to claim 3, which further comprises lower and upper grinders corresponding to said lower and upper rotary cutting blades respectively, said grinders being capable of being brought into contact with and separated from said respective cutting blades.

10. The cutting apparatus according to claim 7, which further comprises lower and upper grinders corresponding to said lower and upper rotary cutting blades respectively, said grinders being capable of being brought into contact with and separated from said respective cutting blades.

* * * * *